US005576754A

United States Patent [19]

Korem

[11] Patent Number: 5,576,754

[45] Date of Patent: Nov. 19, 1996

[54] SHEET HOLDING DEVICE FOR AN ARCUATE SURFACE WITH VACUUM RETENTION

[75] Inventor: Aharon Korem, Herzliya, Israel

[73] Assignee: Scitex Corporation Ltd., Herzliya, Israel

[21] Appl. No.: 217,167

[22] Filed: Mar. 24, 1994

[30] Foreign Application Priority Data

Apr. 2, 1993 [IL] Israel ..... 105275

[51] Int. Cl.[6] ..... B41J 2/47

[52] U.S. Cl. ..... 347/262; 271/271

[58] Field of Search ..... 347/262, 264; 271/256, 271; 346/134, 136

[56] References Cited

U.S. PATENT DOCUMENTS

| | | | |
|---|---|---|---|
| 4,512,505 | 4/1985 | Westley et al. | 226/101 |
| 4,662,622 | 5/1987 | Wimmer et al. | 271/96 |
| 4,705,199 | 11/1987 | Herman et al. | 226/95 |
| 4,754,962 | 7/1988 | Kontz | 271/307 |
| 4,770,404 | 9/1988 | Ueyama et al. | 271/5 |
| 4,853,709 | 8/1989 | Stein | 346/108 |
| 5,323,180 | 6/1994 | Kuberka et al. | 271/276 |

FOREIGN PATENT DOCUMENTS 80241 10/1986 Israel .

*Primary Examiner*—Mark J. Reinhart
*Attorney, Agent, or Firm*—Ladas & Parry

[57] ABSTRACT

A sheet holding device includes a sheet-holder having a concavely-curved surface for receiving a sheet, a sheet feeder at a first end of the concavely-curved surface for feeding a sheet thereon, a releasable holder at the second end of the concavely-curved surface including a recess in the concavely-curved surface at the second end located to be covered by the leading edge of the sheet, and a vacuum-producing device selectively actuatable to produce a vacuum in the recess when covered by the leading edge of the sheet.

14 Claims, 5 Drawing Sheets

SHEET HOLDING DEVICE FOR AN ARCUATE SURFACE WITH VACUUM RETENTION

FIELD AND BACKGROUND OF THE INVENTION

The present invention relates to a sheet-holding device such as is used in an internal drum plotter. The invention also relates to a method for holding a sheet against a surface of such a device, and to an internal drum plotter including such a device.

Internal drum plotters are widely used for transferring visual and other data to recording material. In such plotters, a flexible sheet of light sensitive material such as film is applied to the inner surface of a generally circular cylinder or drum and an optical head located on the central axis of the drum reflects a modulated light beam onto the film. The exposed film is then removed from the drum and a new sheet is inserted. Usually, the light sensitve film is fed from a roll in an input cassette onto the drum and, after being exposed, is cut and removed from the drum into an output cassette.

A crucial aspect in the exposure of the film is that the focal plane of the film retain uniform geometrical precision in relation to the optical head. That is, the distance of the film from the head must be equal over the entire inner surface of the drum. This requires that the film closely and uniformly adhere to the inner surface of the drum.

Several methods are in use today to insure proper adherence of the film to the drum.

In one such method, the film is loaded onto the inner surface of the drum by a loading mechanism and removed from the drum by a discharging mechanism. A slight increase in the loading rate over the discharging rate causes the film to bow outwardly towards the inner surface of the drum. Final adherence is achieved by halting the discharging process slightly before cessation of the loading process.

In another method, a roller is used to feed and press the film onto the drum surface while a vacuum system is applied to the entire inner surface of the drum to hold the film in place.

A third method is described in U.S. Pat. No. 4,853,709, assigned to the applicants. In this method, the film is fed by a film driving roller, and tight engagement with the inner surface is provided by applying a compression force in the plane of the film. This force is attained by a film pressure roller which acts in concert with the film driving roller to feed or hold the film, depending on the position of the pressure roller, and by a film stop bar located at the opposite edge of the film. Final adherence is achieved by the film stop bar applying mechanical pressure on the film at one edge, thereby arresting the film's movement, while at the same time the film pressure roller, acting as a slipping clutch, propels the film forward an additional short distance before halting and securing the film in place.

Although the above methods bring about the adherence of the film to the inner surface of the drum, they suffer from a number of disadvantages. Firstly, the movement of the film suffers from unequal friction between the film and drum surfaces. Due to this unequal friction, it is difficult to keep the film parallel to the circumferential axis of the drum, requiring constant supervision of the loading and discharging processes. In addition, the use of various rollers can cause creases in the film distorting its dimensions. Finally, applying a vacuum along the entire inner surface of the drum causes the areas of the film held by the vacuum to adhere more closely to the drum than the in-between areas, resulting in an uneven adherence of the film to the drum surface.

OBJECTS AND BRIEF SUMMARY OF THE INVENTION

It is an object of the invention to provide a device capable of holding a sheet to a concavely-curved surface.

It is a further object of the invention to provide a concavely-curved surface on which a sheet can proceed with uniform and equal friction at all points of contact.

It is a still further object of the invention to provide a device on whose concavely-curved surface a sheet can be held at a uniform distance from the central axis of the device.

It is another object of the invention to provide a device which can act as a support for laser recording material in an internal drum plotter.

It is still another object of the invention to provide a method for tightly adhering a sheet to a concavely-curved surface.

In accordance with this invention there is thus provided a sheet holding device, including: a sheet-holding member having a concavely-curved surface for receiving a sheet fed thereon; sheet feeding means at a first end of the concavely-curved surface for feeding a sheet thereon such that a leading edge of the sheet moves over the concavely-curved surface from the first end thereof to a second end thereof, the feeding means being capable of holding a trailing edge of the sheet against the concavely-curved surface; and releasable holding means at the second end of the concavely-curved surface selectively actuatable to hold only the leading edge of the sheet against the concavely-curved surface, or to release the leading edge therefrom. The releasable holding means comprises recess means in the concavely-curved surface at the second end thereof located to be covered by the leading edge of the sheet, and vacuum-producing means selectively actuatable to produce a vacuum in the recess means when covered by the leading edge of the sheet, for holding only the leading edge against the concavely-curved surface and thereby for permitting the sheet feeding means, by additionally feeding the sheet when its leading edge is so held against the concavely-curved surface, to press the remainder of the sheet firmly against the concavely-curved surface.

In accordance with this invention there is also provided a method for holding a sheet against a concavely-curved surface of a sheet holding device as defined above comprising: feeding the sheet onto the surface from the first end thereof to the second end thereof; actuating the vacuum-producing means to produce a vacuum in the recess means when covered by the leading edge of the sheet forming the vacuum for holding only the leading edge against the concavely-curved surface; and additionally feeding the sheet when its leading edge is so held against the concavely-curved surface, to press the remainder of the sheet firmly against the concavely-curved surface.

Use of the device of the invention results in a smooth feeding of the sheet onto the concavely-curved surface without having variable frictional forces at its exit cause the sheet to deviate from its path. The sheet is held firmly in place at its exit point while it is driven forward at its entrance point, resulting in its tightly adhering to the concavely-curved surface of the device. The sheet continues to be held in place while it is cut, and during the recording process. On completion of the recording process, the vacuum is released and the sheet can be discharged from the device.

The use of a vacuum restricted to one end of the supporting surface opposite the feeding end overcomes the disadvantages mentioned above. Uniform and stable frictional forces are formed between the film and drum surfaces which do not restrict the feeding process of the film nor cause its mechanical deformation. The frictional forces do not vary over time and are not sensitive to deterioration of mechanical parts such as rollers. Thus, precise mechanical adjustments and/or the use of emulsions having various frictional coeficients are unnecessary. Sheets having a wide range of thicknesses including 0.4 mil film, 0.7 mil film, paper, Bromid and plates may be used with the device of the invention.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

There will now be described two preferred embodiments of the device of the invention for use as a support of light-sensitive sheets in an internal drum plotter.

Figure 1:
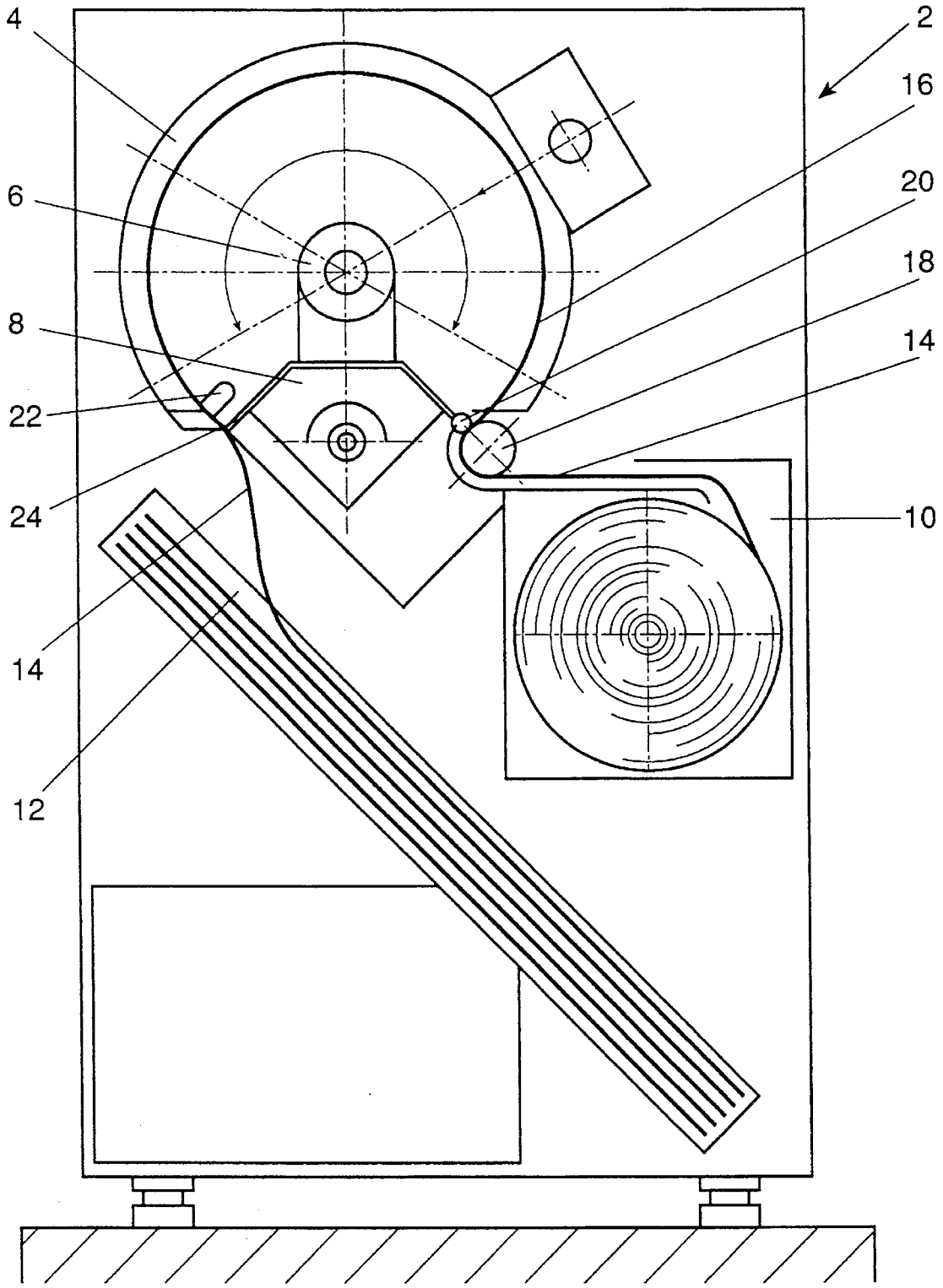
FIG. 1 is a schematic end view of a prior art internal drum plotter and is equivalent to FIG. 5 of applicant's U.S. Pat. No. 4,853,709.

Referring now to FIG. 1, there is illustrated a prior art plotter 2 comprising an incompletely-cylindrical drum 4 for supporting light-sensitive film on its inner surface, an optical scanner assembly 6 which moves along the cylindrical axis of the drum on a carriage 8 for recording on the film, an input cassette 10 near one end of the drum and an output cassette 12 near the opposite end.

In operation, light-sensitive film 14 is fed from the input cassette 10 onto the inner surface 16 of the drum by a film driving roller 18 and a film pressure roller 20. The film 14 is propelled along the inner surface 16 until it reaches the film stop bar 22 which clamps the film, arresting its advance. The pressure roller 20 continues to feed the film for an additional short period of time so that the film is forced to bow outwardly into tight engagement with the inner surface 16 of the drum. The pressure roller then locks on the driving roller 18 thereby securing the film in place. Upon conclusion of the plotting operation for a given portion of film, the film may be cut by a cutter 24 and allowed to fall into the output cassette 12.

Figure 2:
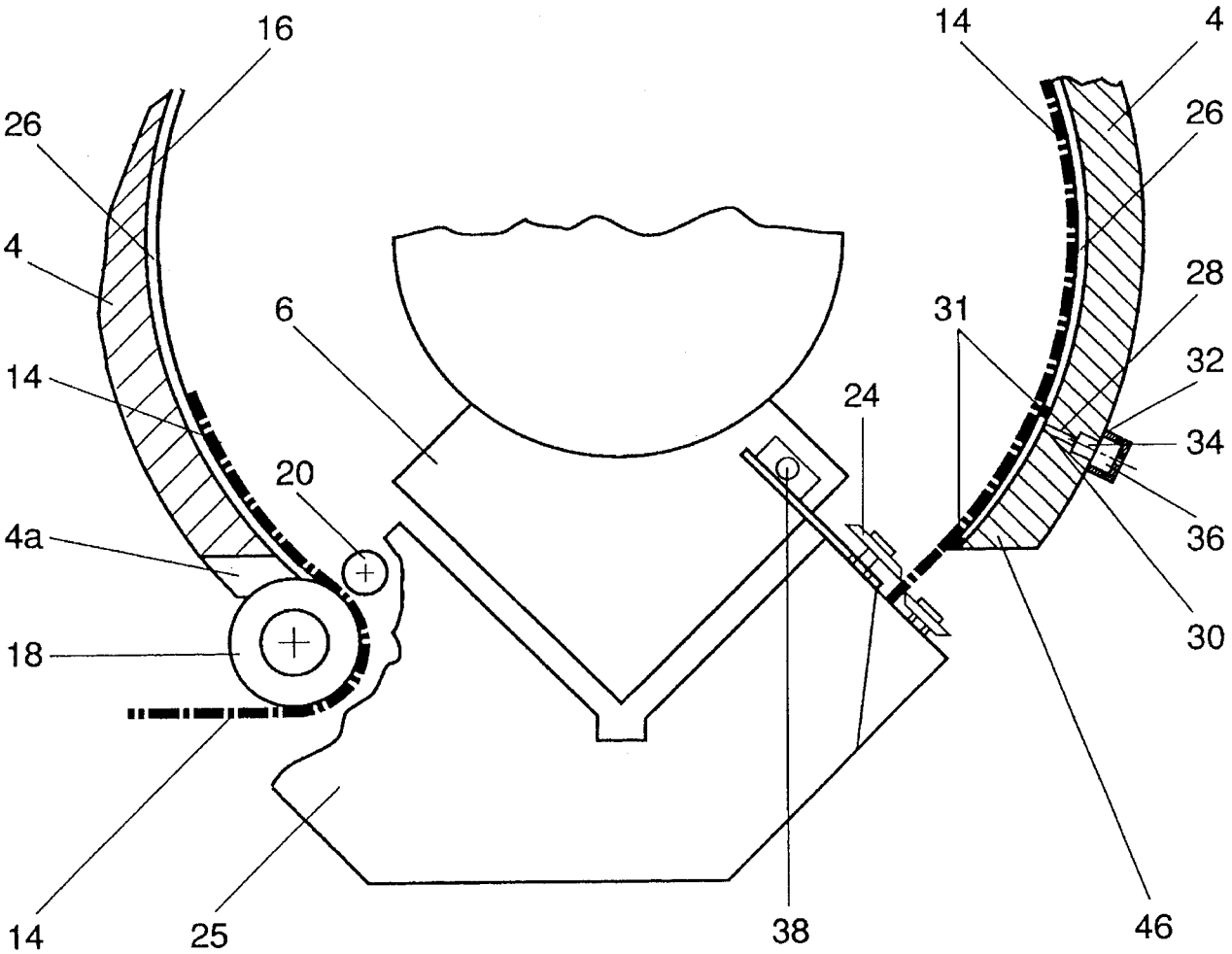
FIG. 2 is a partial sectional end view of an internal drum plotter comprising a device constructed according to one embodiment of the invention.

Referring now to FIG. 2 there is illustrated first **4*a* and second 4*b* axially-extending ends of the incompletely-cylindrical drum 4, an optical scanner assembly 6 on a track 25, film 14 fed onto the concavely-curved inner surface 16 of the drum by the driving roller 18 and pressure roller 20, and the cutter 24 which is attached to the optical assembly 6** for cutting the film.

A series of circumferentially-extending, transversly-spaced recesses in the form of grooves are engraved into the inner surface of the drum, one 26 of which is illustrated in the figure. The main purpose of these grooves is to prevent the film from sticking to the drum surface. Narrow bore channels 28 extend through the drum wall from a section 30 of the grooves, defined by a pair of sealing plugs 31 inserted in the grooves, proximate to the second end **4*b* of the drum. The channels 28 open onto the outer surface 32 of the drum wall as a linear series of apertures 34. A vacuum conduit 36 extends longitudinally along the outer surface 32 of the drum wall and connects the apertures 34 to the vacuum producing means. The operation of the vacuum is controlled, as will be described below, by a pneumatic valve 38 which is attached to the optical assembly 6**.

Figure 3:
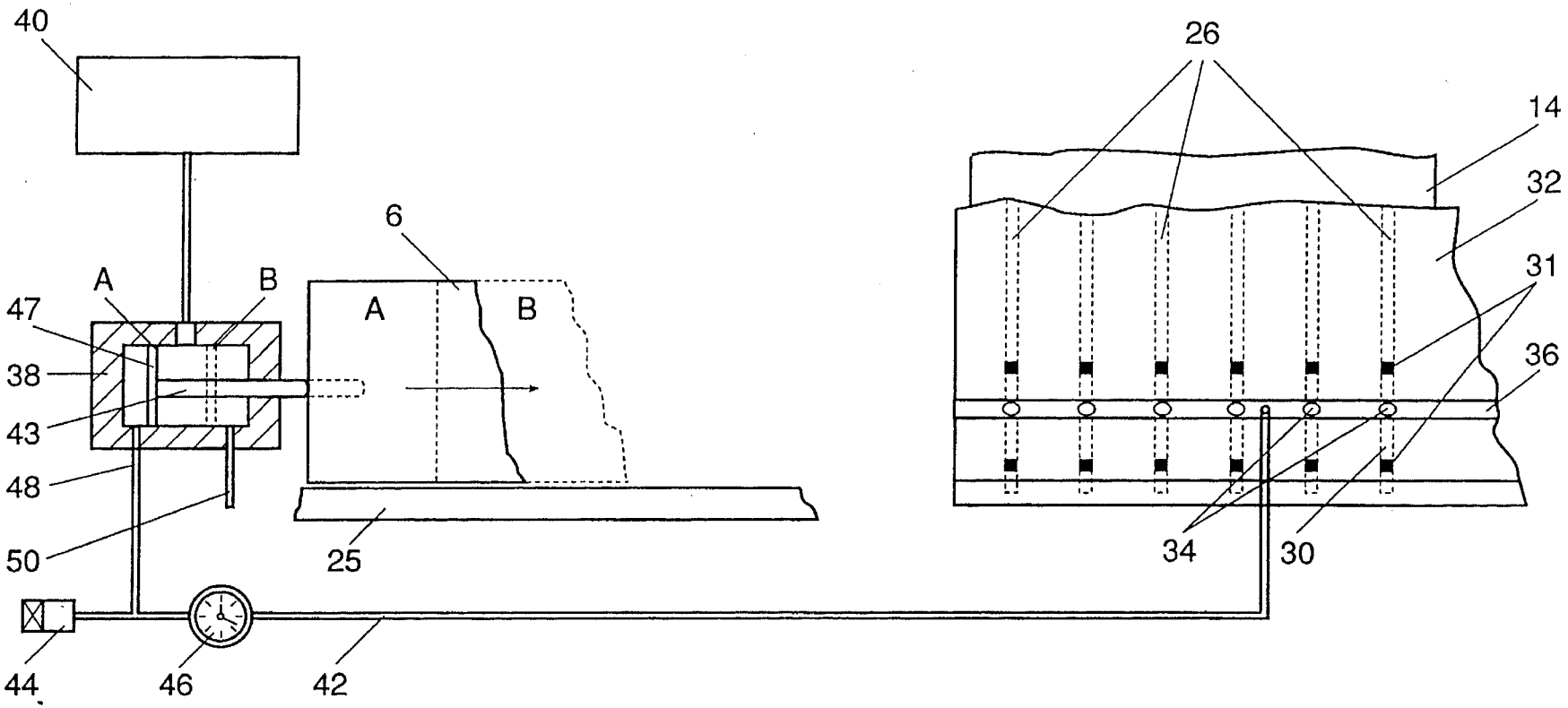
FIG. 3 is a schematic view of the vacuum system of the plotter of FIG. 2, isolated for greater clarity.

FIG. 3 illustrates the vacuum system which comprises a vacuum pump 40, a vacuum channel 42 and a valve 38 which connects between the pump and the channel. The vacuum channel 42 is connected to the conduit 36 which runs along the outer drum wall 32. The valve 38 has a piston 43 which is attached to the optical assembly 6. The channel 42 can optionally include a vacuum regulator 44 for regulating the strength of the vacuum, and a vacuum gauge 46.

The operation of the vacuum system will now be described with reference to FIG. 3. The optical assembly has two positions: one in which it is located proximate to the valve 38 (position 'A'), and one in which it is distal from the valve (position 'B'). In position A, the head 47 of the piston 43 insulates the vacuum produced by the pump 40 from the channel 48 leading to the remainder of the system, and the vacuum is dissipated through a pipe 50 attached to the valve. When the optical assembly moves along the track 25 to position B, the head 47 of the piston is displaced to a new position 'B' thus opening the channel 48 to the vacuum. The vacuum is then conducted through the channel 42, conduit 36 and apertures 34 to form a vacuum in the section 30 of the grooves 26 defined by the sealing plugs 31.

Figure 4:
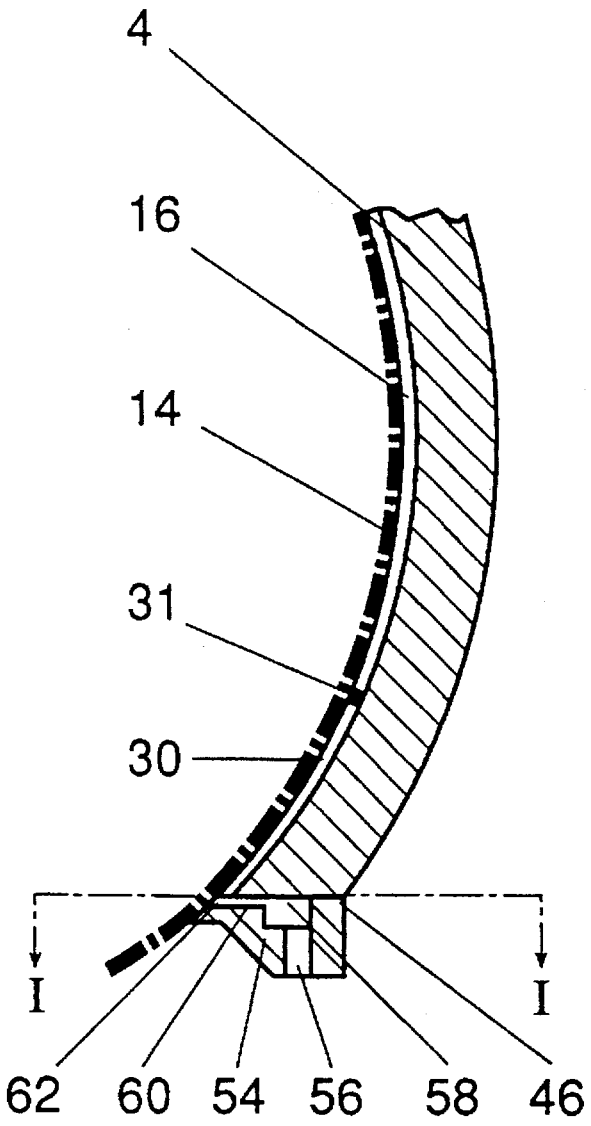
FIG. 4 is a partial sectional end view of a device constructed according to another embodiment of the invention.
Figure 5:
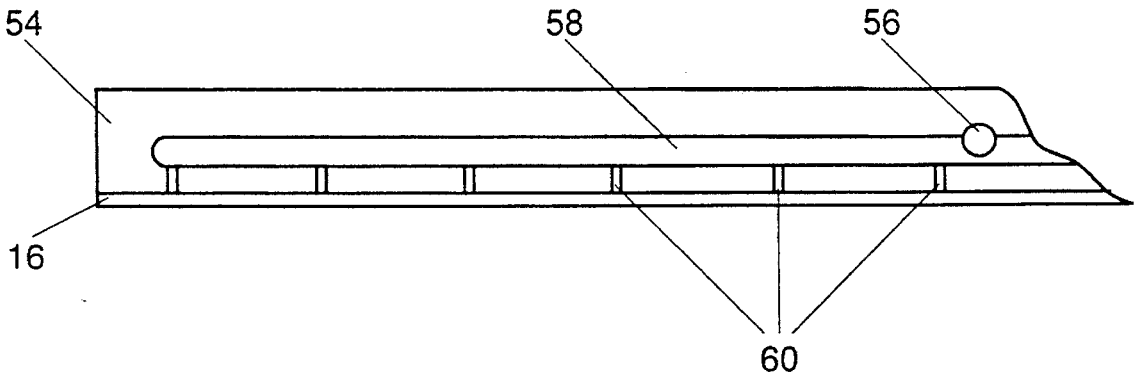
FIG. 5 is a fragmentary sectional top view of a detail of FIG. 4 taken along section I—I rotated 90°.

Another preferred embodiment of the invention is illustrated in FIGS. 4 & 5, in which can be seen a section of the drum wall proximate to the second end **4*b*. Instead of the vacuum reaching the grooves through a bore channel extending through the wall of the drum, an axially-extending element 54 attached to the drum along its second end 4*b* is used. The element 54 has an aperture 56 leading to a conduit 58 which runs along the length of the element and within it, and has narrow bore channels 60 extending from the conduit to the ends 62 of each of the grooves 16. A section 30 of the groove in which the vacuum is formed is defined by one sealing plug 31 inserted in the groove proximate to the second end 4*b*** of the drum.

The method of the invention will now be described with reference to FIGS. 2–4. During the feeding stage, the optical apparatus 6 is in position A. A given portion of film 14 is fed onto the inner surface 16 of the drum by the rollers 18, 20. As the film passes over the grooves 26, a weak vacuum is formed between the under-surface of the film and the grooves due to the rolling of the film over them, so that the film remains in close contact with the inner surface.

When the leading edge of the film portion reaches the second end **4*b* of the drum, the optical apparatus begins to move on the track 25 to position B causing a vacuum to form under the leading edge of the film in the section 30 of the grooves proximate to the second end. The leading edge of the film is tightly secured to the inner surface by the vacuum, and the cutter 24** which is attached to the optical apparatus cuts between the leading edge of the film portion and the film in front of it.

On reaching the opposite end of the track, the optical apparatus halts, and the rollers advance the film an additional pre-determined length so as to tightly adhere the film to the inner surface. The pressure roller 20 then moves to a locking position exerting a compressive force on the film together with the driving roller 18. Thus, the film is held immobile—at its trailing edge by the rollers and at its leading edge by the vacuum. The optical apparatus then records onto the film while proceeding back to position A. On reaching position A, the vacuum is released and the film can be advanced into the output cassette.

It will be appreciated by persons skilled in the art that the present invention is not limited by what has been particularly shown and described hereinabove, but rather the scope of the invention is defined only by the claims.

What is claimed is:

1. A sheet holding device, including:

a sheet-holding member having a concavely-curved surface for receiving a sheet fed thereon;

sheet feeding means at a first end of said concavely-curved surface for feeding a sheet thereon such that a leading edge of said sheet moves over said concavely-curved surface from said first end thereof to a second end thereof, said feeding means being capable of holding a trailing edge of said sheet against said concavely-curved surface; and releasable holding means at said second end of said concavely-curved surface selectively actuatable to hold only said leading edge of the sheet against said concavely-curved surface, or to release said leading edge therefrom;

said releasable holding means comprising:

recess means in said concavely-curved surface at said second end thereof located to be covered by said leading edge of the sheet; and vacuum-producing means selectively actuatable to produce vacuum in said recess means when covered by said leading edge of the sheet, for holding only said leading edge against said concavely-curved surface and thereby for permitting the sheet feeding means, by additionally feeding said sheet when its leading edge is so held against said concavely-curved surface, to press the remainder of the sheet firmly against said concavely-curved surface, wherein said recess means comprises a plurality of grooves formed in said concavely-curved surface at said second end thereof extending parallel to the direction of movement of the sheet over said concavely-curved surface and spaced transversely to said direction of movement of the sheet.

2. The device according to claim 1, wherein said grooves extend substantially completely over said concavely-curved surface, and include transverse sealing plugs restricting the vacuum produced by said vacuum-producing means only to the sections of said grooves at said second end of the concavely-curved surface covered by the leading edge of the sheet fed thereon.

3. The device according to claim 1, wherein said sheet-holding member is a cylinder, and said concavely-curved surface is the inner surface of said cylinder.

4. The device according to claim 3 wherein said cylinder has a gap in its circumference parallel to its longitudinal axis, the borders of said gap defining said first end and said second end of said concavely-curved surface.

5. The device according to claim 1, wherein said vacuum producing means is connected to said recess means through a bore traversing a wall of said sheet-holding member.

6. The device according to claim 1, wherein said vacuum producing means is connected to said recess means through an axially-extending element attached to said second end of said concavely-curved surface.

7. The device according to claim 1, wherein said sheet feeding means comprises a pair of juxtaposed rollers.

8. The device according to claim 1, wherein said sheet includes a light-sensitive film, paper or plate.

9. An internal drum plotter, comprising:

a sheet-holding device according to claim 3;

and scanning means located at the cylindrical axis of said sheet-holding member for recording data on said sheet when held by said sheet holding device.

10. The plotter according to claim 9 wherein said scanning means includes an optical scanner assembly capable of moving along the cylindrical axis of said sheet-holding member.

11. The plotter according to claim 10 wherein said vacuum in said recess means is controlled by the axial movement of said optical assembly.

12. A method for holding a sheet against a concavely-curved surface of a sheet holding device according to claim 1, comprising:

feeding said sheet onto said surface from said first end thereof to said second end thereof;

actuating said vacuum-producing means to produce a vacuum in said recess means when covered by said leading edge of the sheet forming said vacuum for holding only said leading edge against said concavely-curved surface;

and additionally feeding said sheet when its leading edge is so held against said concavely-curved surface, to press the remainder of the sheet firmly against said concavely-curved surface.

13. The device according to claim 2 wherein said vacuum producing means comprises a row of channels in said sheet-holding member opening into said sections of said grooves at said second end of the concavely-curved surface of said sheet holding member.

14. The device according to claim 13 wherein said channels of said vacuum producing means are confined to said sections of said grooves at said second end of the concavely-curved surface of said sheet holding member, said sheet holding member being solid and without channels outside said sections of said grooves.

* * * * *